US008317530B2

(12) United States Patent
Sawairi et al.

(10) Patent No.: US 8,317,530 B2
(45) Date of Patent: Nov. 27, 2012

(54) WATERPROOF CONNECTOR HAVING A PACKING WITH EXTERIOR RIDGES OF DIFFERENT HEIGHTS

(75) Inventors: Kaoru Sawairi, Makinohara (JP); Shigeru Tanaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 300 days.

(21) Appl. No.: 12/756,654

(22) Filed: Apr. 8, 2010

(65) Prior Publication Data

US 2010/0267264 A1 Oct. 21, 2010

(30) Foreign Application Priority Data

Apr. 17, 2009 (JP) ..... 2009-101016

(51) Int. Cl.
*H01R 13/52* (2006.01)

(52) U.S. Cl. ..... 439/271

(58) Field of Classification Search ..... 439/271–275, 439/587, 157

See application file for complete search history.

(56) References Cited

U.S. PATENT DOCUMENTS 5,735,702 A * 4/1998 Hio ..... 439/157
6,045,383 A * 4/2000 Fujiwara ..... 439/271
6,186,814 B1 * 2/2001 Matsushita ..... 439/271
6,368,132 B1 * 4/2002 Okayasu ..... 439/273
6,398,571 B1 6/2002 Nishide et al.

FOREIGN PATENT DOCUMENTS

| | | | |
|---|---|---|---|
| EP | 0736935 | A3 | 5/1997 |
| EP | 0975061 | A3 | 4/2000 |
| GB | 2274558 | A | 7/1994 |
| JP | 9-330763 | A | 12/1997 |
| JP | 2002-151194 | A | 5/2002 |

OTHER PUBLICATIONS

Search Report issued Aug. 16, 2010, in counterpart British Application No. GB1006198.4.

* cited by examiner

*Primary Examiner* — Chandrika Prasad
(74) *Attorney, Agent, or Firm* — Sughrue Mion, PLLC

(57) ABSTRACT

In a waterproof connector, an annular packing 33 is mounted on an outer periphery of a tubular fitting portion of a connector housing, and when a fitting portion of a mating connector is fitted to the tubular fitting portion, the annular packing forms a seal between the two fitting portions. An annular ridge 41 is formed on an outer periphery of the packing 33, and the annular ridge 41 is formed into a generally mountain-shape and has a pair of inclined surfaces 41*a* and 41*b* inclining respectively in opposite directions along an axis of the tubular fitting portion. An angle α of inclination of the inclined surface 41*a* disposed close to a front end of the packing disposed at an insertion side of the tubular fitting portion is larger than an angle of inclination of the other inclined surface 41*b*.

3 Claims, 5 Drawing Sheets

This avoids the problem of the prior art, see Fig. 8 wherein an improperly deformed portion 529 is produced:

WATERPROOF CONNECTOR HAVING A PACKING WITH EXTERIOR RIDGES OF DIFFERENT HEIGHTS

BACKGROUND OF THE INVENTION

1. Field of the Invention

This invention relates to a waterproof connector having an annular packing mounted on an outer periphery of a fitting portion of a connector housing.

2. Description of the Related Art

There is known a waterproof connector of the type in which an annular packing is mounted on an outer periphery of a tubular fitting portion of a connector housing, and when a fitting portion of a mating connector is fitted to the tubular fitting portion, the annular packing forms a seal between the two fitting portions. For example, in a female terminal connector 500 shown in FIG. 5 and disclosed in Patent Literature 1, a tubular fitting portion 505 for receiving female terminals 503 therein is formed within a tubular case member 501, and an annular packing 507 is mounted on an outer periphery of the tubular fitting portion 505. A cap member 509 is fitted on a distal end portion of the tubular fitting portion 505, and the packing 507 is held between the cap member 509 and a support wall 511.

As shown in FIG. 6, the packing 507 has a two-layer structure and therefore has two annular layers, that is, an outer peripheral layer 513 and an inner peripheral layer 515, adhesively bonded together as shown in FIG. 6. Annular ridges 519 are formed on an outer peripheral surface 517 of the outer peripheral layer 513, so that this outer peripheral surface 517 has a concave-convex shape (that is, a corrugated shape). Annular grooves 523 are formed in an inner peripheral surface 521 of the inner peripheral layer 515, so that this inner peripheral surface 521 has a shallow concave-convex shape.

When the female terminal connector 500 is connected to a male terminal connector (mating connector) 525 as shown in FIG. 7, a fitting portion 527 of the male terminal connector 525 is fitted on the outer periphery of the cap member 509, and also a distal end portion of this fitting portion 527 is fitted on the outer periphery of the packing 507. As a result, the ridges 519 of the packing 507 mounted on the tubular fitting portion 505 are elastically deformed to be held in intimate contact with an inner peripheral surface of the fitting portion 527, thereby forming a seal between the fitting portions 505 and 527 of the female and male terminal connectors 500 and 525, thus preventing the intrusion of water, dirt and dust.

Patent Literature 1: JP-A-2002-151194

A water-tight and air-tight sealing performance of the packing 507 is obtained by suitably deforming the ridges 519.

However, when the packing 507 was formed into the oilless type, the coefficient of friction increased, so that its sliding performance was lowered. In this case, a distal end of an apex portion 519*a* of the ridge 519 was pulled or deformed in a direction (direction of arrow a) of fitting of the fitting portion 527, and an improperly-deformed portion 529, for example, of an overhanging shape was formed as shown in FIG. 8. Such deformed portion 529 caused the catching, turning-up and buckling of the packing, and increased an inserting resistance, and also the strength of intimate contact of the packing with the inner peripheral surface of the fitting portion 527 was lowered, and as a result the inserting ability and the waterproof performance were lowered.

SUMMARY OF THE INVENTION

This invention has been made in view of the above circumstances, and an object of the invention is to provide a waterproof connector in which an annular ridge of a packing can be suitably deformed, and by doing so, the catching, turning-up and buckling of the packing are prevented, thereby enhancing an inserting ability and a waterproof performance.

The above object has been achieved by the following constructions.

(1) A waterproof connector, in which an annular packing is mounted on an outer periphery of a tubular fitting portion of a connector housing, and when a fitting portion of a mating connector is fitted to said tubular fitting portion, said annular packing forms a seal between the two fitting portions; wherein an annular ridge is formed on an outer periphery of said packing; and said annular ridge is formed into a generally mountain-shape and has a pair of inclined surfaces inclining respectively in opposite directions along an axis of said tubular fitting portion, and an angle of inclination of the inclined surface disposed close to a front end of said packing disposed at an insertion side of said tubular fitting portion is larger than an angle of inclination of the other inclined surface.

In this waterproof connector, the amount of an elastic material of the other inclined surface extending away from the front end-side inclined surface (that is, the volume from the apex portion to a foot of the annular ridge) is increased, and this construction offers a higher resistance to a force acting on the annular ridge in the fitting direction. Therefore, the apex portion of the annular ridge is prevented from being pulled in the fitting direction, thus preventing an improperly-deformed portion, for example, of an overhanging shape from being formed at the annular ridge. Therefore, the annular ridge can be properly deformed or squeezed into a deformed portion of a good waterproof performance having the pair of oppositely-inclined surfaces disposed generally symmetrically.

(2) The waterproof connector according to (1), wherein a plurality of said annular ridges are formed on the outer periphery of said tubular fitting portion, and are arranged along said axis.

In this waterproof connector, the intrusion of water and others into the connector is prevented in a multi-stage manner, thereby further enhancing the waterproof performance.

(3) The waterproof connector according to claim 2), wherein the front end annular ridge of the mountain-shape disposed close to said front of said packing is smaller in height than the rear end annular ridge of the mountain-shape disposed close to a rear end of said packing.

In this waterproof connector, as compared with the case where the plurality of annular ridges have the same height, the fitting force can be reduced so as to enhance the efficiency of the fitting operation. Furthermore, the front end annular ridge of a smaller height is first fitted to the fitting portion of the mating connector, and then the rear end annular ridge of a larger height is fitted to the fitting portion of the mating connector, and therefore the fitting operation can be initiated easily, and this can also enhance the efficiency of the fitting operation.

(4) The waterproof connector according to (1), wherein an apex portion of each of said mountain-shaped annular ridges is defined by a convexly-curved surface interconnecting said pair of inclined surfaces.

In this waterproof connector, the apex portions is formed by the convexly-curved surface, and therefore the apex portion is less liable to be pulled or deformed in the fitting direction as compared with the case where the apex portion has a corner portion. Therefore, an improperly-deformed portion (for example, of an overhanging shape) which would lower the waterproof ability is less liable to be formed at the annular ridge, so that the inserting ability and the waterproof performance are further enhanced.

In the waterproof connector of the present invention, the packing is mounted on the outer periphery of the tubular fitting portion, and the annular ridges of the mountain-shape are formed on the outer periphery of the packing, and the inclination angle of the inclined surface disposed close to the insertion-side front end of the packing is larger than the inclination angle of the other inclined surface. Therefore, the annular ridge can be properly deformed, and the catching, turning-up and buckling of the packing are prevented, thereby enhancing the inserting ability and the waterproof performance.

BRIEF DESCRIPTION OF THE PREFERRED EMBODIMENTS

Figure 4A:
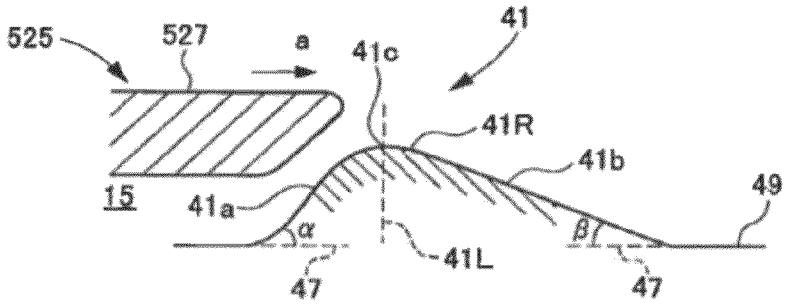
Figure 4B:
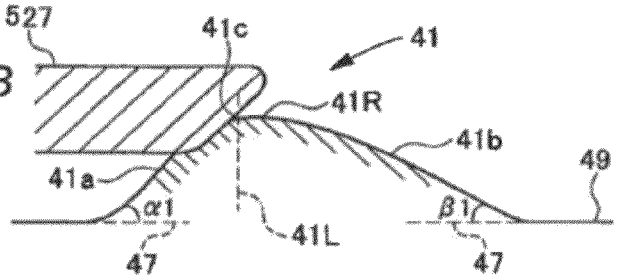
Figure 4C:
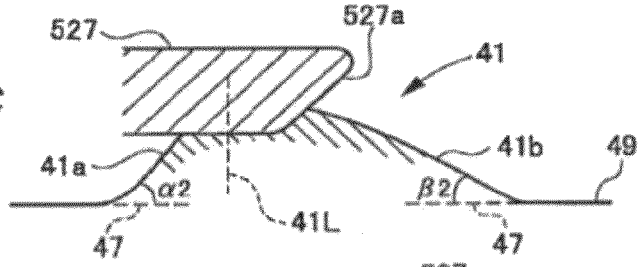
Figure 4D:
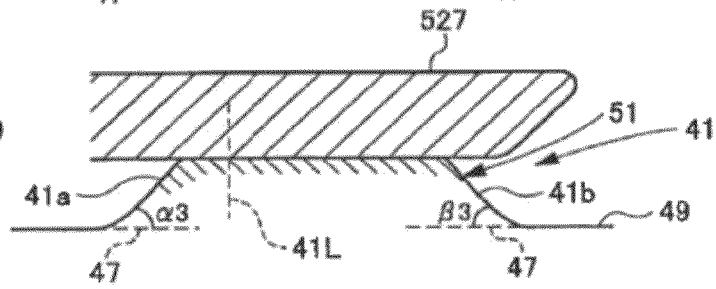

FIG. 4A is an enlarged view showing the annular ridge before a fitting operation, FIG. 4B is an enlarged view showing the annular ridge in its initially-squeezed (or deformed) condition, FIG. 4C is an enlarged view showing the annular ridge when a fitting portion of a mating connector moves beyond a neutral position, and FIG. 4D is an enlarged view showing the annular ridge in its completely-deformed condition.

Figure 5:
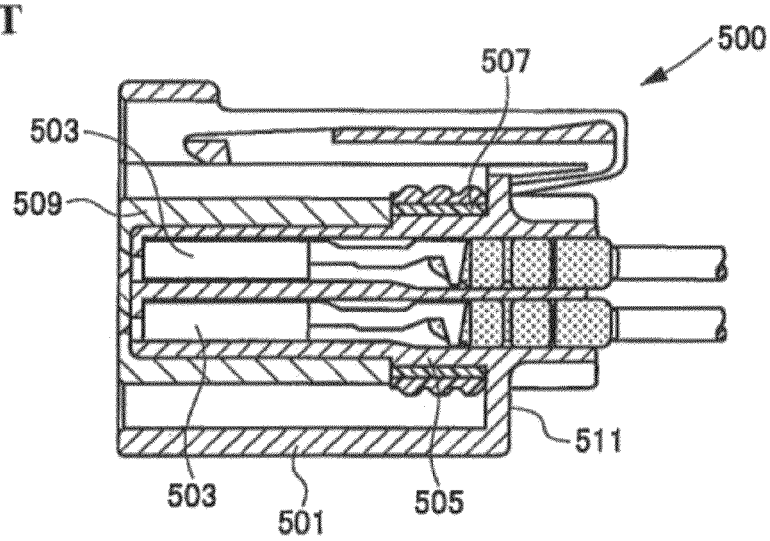
FIG. 5 PRIOR ART

FIG. 5 is a cross-sectional view of a conventional female terminal connector.

Figure 6:
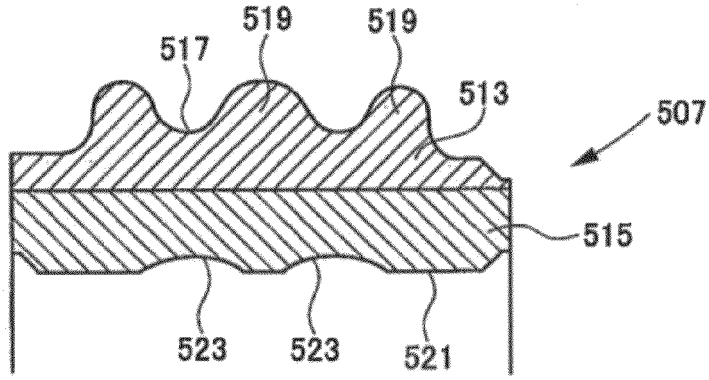
FIG. 6 PRIOR ART

FIG. 6 is an enlarged view of an important portion of a packing of FIG. 5.

Figure 7:
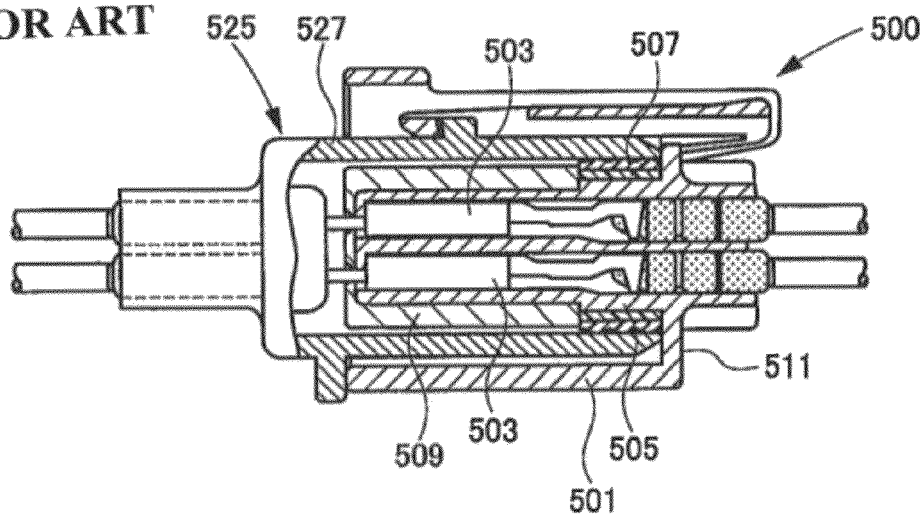
FIG. 7 PRIOR ART

FIG. 7 is a cross-sectional view showing a condition in which a male terminal connector is fitted to the conventional female terminal connector.

Figure 8:
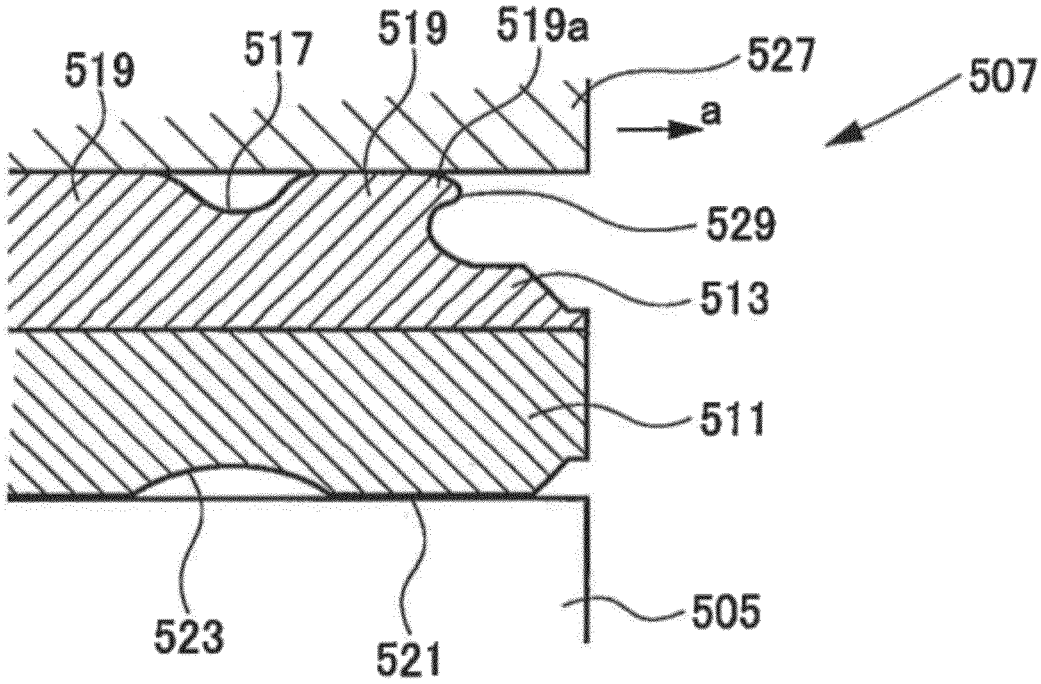
FIG. 8 PRIOR ART

FIG. 8 is an enlarged view of an important portion of the packing having an improperly-deformed portion formed at a ridge thereof.

DESCRIPTION OF THE PREFERRED EMBODIMENTS

A preferred embodiment of the present invention will now be described with reference to the drawings.

Figure 1:
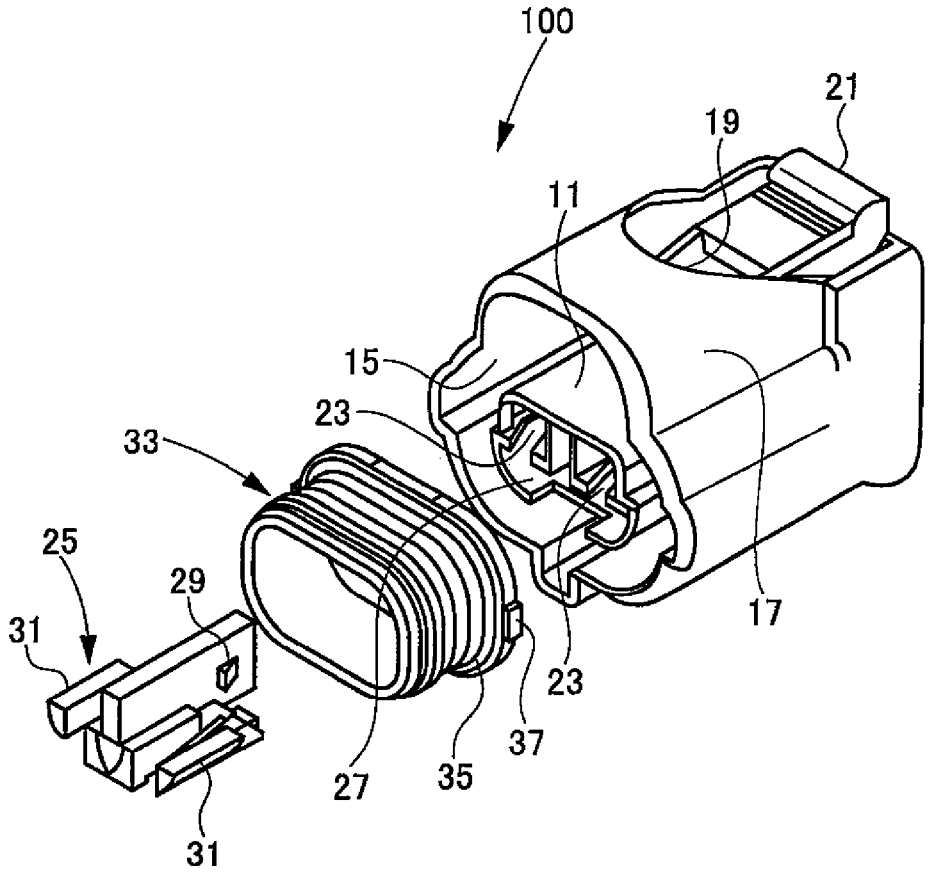
FIG. 1 is an exploded perspective view of a waterproof connector of the present invention.

FIG. 1 is an exploded perspective view of a waterproof connector of the invention. In the following description, that side of the waterproof connector for fitting to a mating connector will be referred to as "the front side", and the opposite side will be referred to as "the rear side".

The female connector 100 which is the waterproof connector includes a housing body (tubular fitting portion) 11 having terminal receiving chambers formed therein. An outer periphery of this housing body 11 serves as a fitting portion on which the mating connector (corresponding to the male terminal connector 525 of FIG. 7) can be fitted. The female connector 10 further includes a hood portion 17 formed around the outer periphery of the housing body 11, and a space 15 for receiving a fitting portion (corresponding to the fitting portion 527 of FIG. 7) of the mating connector therein is formed between the housing body 11 and the hood portion 17. The hood portion 17 is integrally connected with the housing body 11 at a rear wall of this housing body 11.

A curved notch 19 is formed in a rear portion of the hood portion 17, and a lock arm 21 having a free rear end is disposed in the notch 19. The lock arm 21 serves to hold the mating connector in a fitted condition relative to the female connector 100. Insertion ports 23 and 23 for the insertion of male terminals of the mating connector therethrough are formed at the front side or face of the housing body 11. An insertion port 27 for the insertion of a front holder 25 therethrough is formed between the insertion portions 23 and 23 and also at a region below these insertion portions. Elastic retaining piece portions (or lances) are formed respectively within the terminal receiving chambers of the housing body 11, and are retainingly engaged respectively with female terminals received respectively within the terminal receiving chambers, thereby preventing the withdrawal of the female terminals. When the front holder 25 is inserted through the insertion port 27, retaining portions 29 of the front holder 25 are retainingly engaged respectively with retaining means (not shown) provided within the housing body 11, and also restraining portions 31 and 31 of the front holder 25 are located adjacent respectively to the elastic retaining piece portions to prevent these elastic retaining piece portions from being brought out of retaining engagement with the respective female terminals, thereby retaining the female terminals in a double manner.

The housing body 11 is formed into a generally elliptical cross-section, and a packing 33 of a generally elliptical cross-section is mounted on the outer periphery of the housing body 11 such that an inner peripheral surface of the packing 33 is held watertight and airtight in intimate contact with the outer peripheral surface of the housing body 11. A radially outwardly-projecting flange 35 is formed at a rear end of the packing 33 over an entire periphery thereof. When the packing 33 is mounted on the housing body 11, a rear face of the flange 35 is held against the rear wall (not shown) of the housing body 11. A distal end of the fitting portion of the mating connector is adapted to be held in intimate contact with a front face of the flange 35. A pair of projections 37 are integrally formed respectively at opposite (right and left) side portions of the flange 35, and these projections 37 are retainingly engaged respectively in retaining recesses formed within the hood portion 17, thereby preventing the packing 33 from being withdrawn from the female connector 100.

The packing 33 can be formed, using a rubber material (such as silicone rubber, nitrile rubber or acrylic rubber) or a rubber-like material. The packing 33 can be composed of a plurality of annular layers as in the conventional structure, and these annular layers can be formed of different materials, respectively. For example, the mounting-side annular layer (inner layer) for mounting on the housing body 11 can have a high hardness, while the fitting contact-side annular layer (outer layer) for fitting in the fitting portion of the mating connector can have a low hardness.

Figure 2:
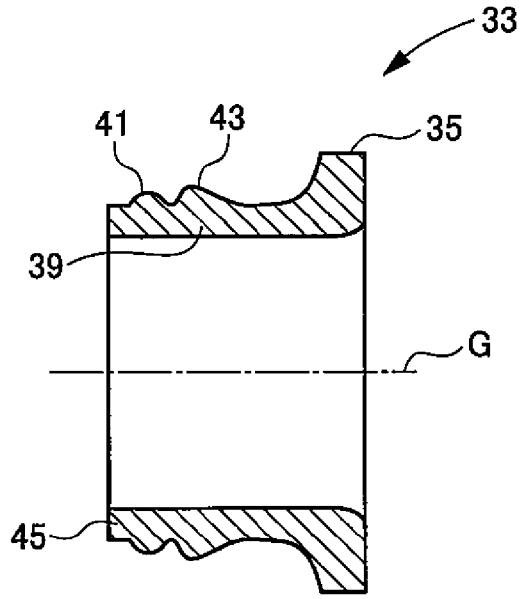
FIG. 2 is a cross-sectional view of a packing of FIG. 1 through a plane including an axis of this packing.

FIG. 2 is a cross-sectional view of the packing 33 through a plane including the axis of the packing 33.

The packing 33 is mounted on the outer periphery of the housing body 11 on which the fitting portion of the mating connector is adapted to be fitted, and this packing 33 serves to form a seal between the fitting portion of the female connector 100 and the fitting portion of the mating connector. The packing 33 includes a packing body 39 of a generally elliptical shape, and annular ridges 41 and 43 are formed on an outer periphery of the packing body 39. A plurality of (two in the illustrated embodiment) annular ridges 41 and 43 are formed on the packing body 39, and are arranged along an axis of the packing body 39 (and hence along the axis X of the housing body 11). Thanks to the provision of the plurality of annular ridges 41 and 43, the intrusion of water and others into the connector from the fitting end side (the flange (35) side) of the packing body 39 is prevented in a multi-stage manner, thereby further enhancing the waterproof performance.

Figure 3:
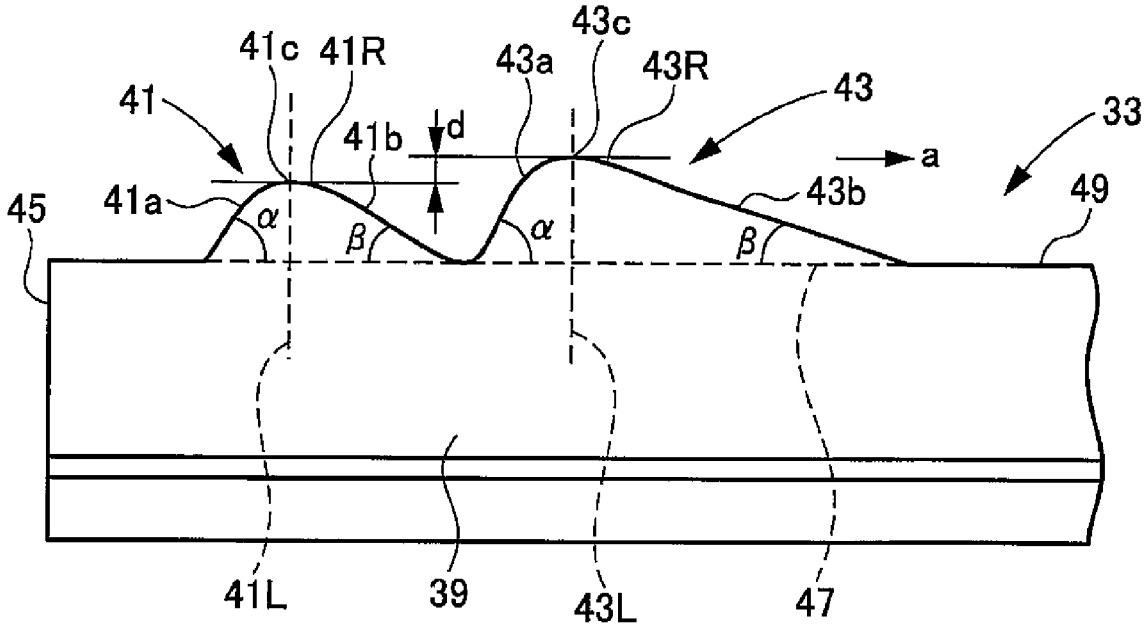
FIG. 3 is an enlarged view showing annular ridges of the packing of FIG. 2.

FIG. 3 is an enlarged view showing the annular ridges of the packing of FIG. 2.

The annular ridge 41 is formed into a generally mountain-shape (that is, a generally triangular cross-section) having a pair of inclined surfaces 41*a* and 41*b* inclining respectively in opposite directions along the axis G of the housing body 11. Similarly, the annular ridge 43 is formed into a generally mountain-shape (that is, a generally triangular cross-section) having a pair of inclined surfaces 43*a* and 43*b* inclining respectively in opposite directions along the axis G of the housing body 11. An angle α of inclination of the inclined surface 41*a*, 43*a* of each annular ridge disposed close to a housing body (11) insertion-side front end 45 of the packing 33 is larger than an angle β of inclination of the other inclined surface 41*b*, 43*b* disposed close to the rear end of the packing 33 (α>β).

The front end annular ridge 41 of the mountain-shape disposed close to the housing body (11) insertion-side front end 45 is smaller in height than the rear end annular ridge 43 of the mountain-shape disposed close to the rear end of the packing 33 such that a height difference d is provided between the two annular ridges 41 and 43. In this embodiment, the annular ridges 41 and 43 are similar in shape to each other. Namely, the front end annular ridge 41 is smaller in size, so that the height difference d is provided.

The packing body 39 in which the height difference d is provided between the annular ridges 41 and 43 can reduce the fitting force so as to enhance the efficiency of the fitting operation as compared with the case where the plurality of annular ridges 41 and 43 have the same height. Furthermore, the front end annular ridge 41 of a smaller height is first fitted to the fitting portion of the mating connector, and then the rear end annular ridge 43 of a larger height is fitted to the fitting portion of the mating connector, and therefore the fitting operation can be initiated easily, and this can also enhance the efficiency of the fitting operation.

A mountain-shaped apex portion 41*c*, 43*c* of each annular ridge 41, 43 is defined by a convexly-curved surface 41R, 43R interconnecting the pair of inclined surfaces 41*a* and 41*b*, 43*a* and 43*b*. Since each apex portion 41*c*, 43*c* is thus formed by the convexly-curved surface 41R, 43R, the apex portion 41*c*, 43*c* is less liable to be pulled or deformed in the fitting direction (direction of arrow a) as compared with the case where the apex portion has a corner portion. Therefore, an improperly-deformed portion (such for example as the improperly-deformed portion 529 of the overhanging shape shown in FIG. 8) which would lower the waterproof ability is less liable to be formed at each annular ridge 41, 43, so that the inserting ability and the waterproof performance are further enhanced. In FIG. 3, reference numerals 41L and 43L denote neutral lines passing respectively through the apex portions 41*c* and 43*c* and perpendicularly intersecting the axis G. Reference numeral 47 denotes an imaginary extension line of the outer peripheral surface 49 of the packing body 39.

Next, the operation of the female connector 100 having the above construction will be described.

FIG. 4A is an enlarged view showing the annular ridge before the fitting operation, FIG. 4B is an enlarged view showing the annular ridge in its initially-squeezed (or -deformed) condition, FIG. 4C is an enlarged view showing the annular ridge when the fitting portion of the mating connector moves beyond the neutral position, and FIG. 4D is an enlarged view showing the annular ridge in its completely-deformed condition.

The packing 33 is mounted on the outer periphery of the housing body 11 of the female connector 100, and in this condition the female connector 100 is connected to the mating connector 525. When this connecting operation is started, the fitting portion 527 of the mating connector 525 is inserted into the space 15 as shown in FIG. 4A.

At this time, the fitting portion 527 presses the inclined surface 41*a* of the front end annular ridge 41, so that the inclination angle α of the inclined surface 41 is reduced into an inclination angle α1 as shown in FIG. 4B. When the inclined surface 41*a* of the annular ridge 41 is thus pressed by the fitting portion 527, the annular ridge 41 is deformed such that part of its volume corresponding to an amount replaced by the distal end portion of the fitting portion 527 is shifted to the rear side of the neutral position 41L, so that the inclination angle β is increased into an inclination angle β1. At this time, the inclined surface 41*b* is gently bulged since the inclination angle β1 is smaller than the inclination angle α1.

When the fitting portion 527 is further inserted, the distal end 527*a* of the fitting portion 527 passes the neutral position 41L as shown in FIG. 4C. In this condition, also, part of the volume disposed forwardly of the neutral position 41L is shifted to the rear side of the neutral position 41L, so that the inclination angle α1 is reduced into an inclination angle α2. On the other hand, the inclination angle β1 is increased into an inclination angle β2. In this condition, also, the inclination angle β2 is smaller than the inclination angle α2, and therefore an improperly-deformed portion (such for example as the improperly-deformed portion 529 of the overhanging shape (see FIG. 8) produced in the conventional structure) will not be produced.

When the distal end 527*a* of the fitting portion 527 passes the inclined surface 41*b* and is brought into abutting engagement with the front face of the flange 35, the fitting operation is completed. In this fitting-completed condition, part of the volume disposed forwardly of the neutral position 41L before the fitting operation, as well as that portion of the volume disposed in the vicinity of the apex portion 41*c* pressed down by the fitting portion 527, is shifted to the rear side of the neutral position 41L. As a result, the inclined surface 41*a* and the inclined surface 41*b* are urged to be shifted rearwardly, so that the inclined surfaces 41*a* and 41*b* have their respective inclination angles α3 and β3 which are generally equal to each other. With respect to the change of the inclination angles α and β in the process of deformation of the annular ridge 41, the following relations are established: $\alpha>\alpha 1>\alpha 2>\alpha 3$, $\beta<\beta 1<\beta 2<\beta 3$, $\alpha 1>\beta 1$, $\alpha 2>\beta 2$, $\alpha 3\approx\beta 3$.

Although the above explanation has been made taking the annular ridge 41 as an example, the annular ridge 43 similar in shape to the annular ridge 41 is also deformed similarly, and therefore explanation thereof will be omitted.

In this female connector 100, for example with respect to the annular ridge 41, the amount of the elastic material (rubber material) of the other inclined surface 41*b* (that is, the volume from the apex portion 41*c* to the foot of the annular ridge) is larger as compared with the inclined surface 41*a* disposed close to the insertion-side front end 45, and this construction offers a higher resistance to a force acting on the annular ridge 41 in the fitting direction. Therefore, the apex portion 41*c* of the annular ridge 41 is prevented from being pulled or deformed in the fitting direction a, thus preventing an improperly-deformed portion, for example, of an overhanging shape from being formed at the annular ridge 41. Therefore, the annular ridge 41 can be properly deformed or squeezed into a deformed portion 51 (see FIG. 4) of a good waterproof performance having the pair of oppositely-inclined surfaces 41*a* and 41*b* disposed generally symmetrically.

As described above, in the female connector 100 of the above construction, the packing 33 is mounted on the outer periphery of the housing body 11, and the mountain-shaped annular ridges 41 and 43 are formed on the outer periphery of the packing 33, and the inclination angle $\alpha$ of the inclined surface 41*a*, 43*a* of each annular ridge 41, 43 disposed close to the insertion-side front end 45 is larger than the inclination angle $\beta$ of the other inclined surface 41*b*, 43*b*. Therefore, the annular ridge 41, 43 can be properly deformed, and the catching, turning-up and buckling of the packing 33 are prevented, thereby enhancing the inserting ability and the waterproof performance.

What is claimed is:

1. A waterproof connector, in which an annular packing is mounted on an outer periphery of a tubular fitting portion of a connector housing, and when a fitting portion of a mating connector is fitted to said tubular fitting portion, said annular packing forms a seal between the two fitting portions;

wherein an annular ridge is formed on an outer periphery of said packing;

wherein said annular ridge is formed into a generally mountain-shape and has a pair of inclined surfaces inclining respectively in opposite directions along an axis of said tubular fitting portion, and in an undeformed state, an angle of inclination of the inclined surface disposed close to a front end of said packing disposed at an insertion side of said tubular fitting portion is larger than an angle of inclination of the other inclined surface;

wherein a plurality of annular ridges are formed on the outer periphery of said packing, and are arranged along said axis; and wherein the front end annular ridge of the mountain-shape disposed close to said front of said packing is smaller in height than the rear end annular ridge of the mountain-shape disposed close to a rear end of said packing.

2. The waterproof connector according to claim 1, wherein an apex portion of each of said mountain-shaped annular ridges is defined by a convexly-curved surface interconnecting said pair of inclined surfaces.

3. The waterproof connector according to claim 1, wherein the front end annular ridge of the mountain-shape disposed close to said front of said packing is similar in shape to the rear end annular ridge of the mountain-shape disposed close to a rear end of said packing.

* * * * *